US007036226B2

(12) United States Patent
Saito et al.

(10) Patent No.: US 7,036,226 B2
(45) Date of Patent: May 2, 2006

(54) CRIMP STATE ESTIMATION APPARATUS FOR CRIMP CONTACT TERMINAL AND QUALITY DETERMINATION APPARATUS FOR CRIMP CONTACT TERMINAL

(75) Inventors: Megumi Saito, Haibara-gun (JP); Naoki Ito, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 190 days.

(21) Appl. No.: 10/776,599

(22) Filed: Feb. 12, 2004

(65) Prior Publication Data

US 2004/0221634 A1 Nov. 11, 2004

(30) Foreign Application Priority Data

Feb. 13, 2003 (JP) ..... P2003-035754

(51) Int. Cl.
*H01R 43/04* (2006.01)

(52) U.S. Cl. ..... 29/863; 29/715; 29/857; 29/861; 72/14.8; 72/16.4; 72/17.2; 72/18.9; 72/20.1; 72/21.1; 72/21.3; 72/712

(58) Field of Classification Search ..... 29/715, 29/857, 861, 863; 72/14.8, 16.4, 17.2, 18.9, 72/20.1, 21.1, 21.3, 712
See application file for complete search history.

(56) References Cited

U.S. PATENT DOCUMENTS 5,669,257 A * 9/1997 Inoue et al. ..... 72/20.1
5,887,469 A * 3/1999 Maeda et al. ..... 72/20.1
5,966,806 A * 10/1999 Maeda et al. ..... 29/863

* cited by examiner

*Primary Examiner*—Derris H. Banks
*Assistant Examiner*—Hung C. Le
(74) *Attorney, Agent, or Firm*—Sughrue Mion, PLLC

(57) ABSTRACT

A crimp state estimation apparatus includes: an information input section for inputting information on an crimp contact terminal, an electric wire, an anvil, and the crimper and an input compression ratio of a core wire of the electric wire; and an estimation unit for calculating a total length of the bottom wall and the pair of crimp pieces after crimp in a cross section orthogonal to the core wire based on the information and the input compression ratio and estimating a cross-sectional shape of the bottom wall and the pair of crimp pieces after crimp based on the total length.

3 Claims, 14 Drawing Sheets

CRIMP STATE ESTIMATION APPARATUS FOR CRIMP CONTACT TERMINAL AND QUALITY DETERMINATION APPARATUS FOR CRIMP CONTACT TERMINAL

BACKGROUND OF THE INVENTION

This invention relates to a crimp state estimation apparatus for a crimp contact terminal that can estimate the crimp state without actually prototyping a crimp contact terminal and a quality determination apparatus for a crimp contact terminal that can determine whether the crimp contact terminal is good or bad based on the estimated crimp state.

Various electronic machines are installed in an vehicle as a mobile unit. Thus, in the vehicle, a wire harness is installed for transmitting predetermined electric power and signals to the electronic machines. The wire harness includes a plurality of electric wires and connectors attached to ends of the electric wires, etc.

Each electric wire includes a conductive core wire and an insulating sheath for covering the core wire. Each connector includes a terminal fitment attached to the electric wire and a connector housing for housing the terminal fitment. The terminal fitment is implemented as a conductive metal sheet, etc. The terminal fitment is electrically connected to the core wire of the electric wire. The connector housing is made of an insulating synthetic resin and is formed like a box.

The wire harness has the connectors connected to connectors of the electronic machines, etc., for transmitting predetermined electric power and signals to the electronic machines.

A crimp contact terminal may be used as the terminal fitment of the wire harness described above. The crimp contact terminal includes a bottom wall for positioning the core wire of an electric wire on a surface and a pair of crimp pieces upright from both margins of the bottom wall. As the crimp contact terminal has the crimp pieces bent toward the bottom wall, the core wire of the electric wire is attached to the top of the bottom wall. Thus, the crimp contact terminal is fixed to the electric wire as the core wire is crimped with the crimp pieces.

In the wire harness described above, a plurality of types of electric wires different in the outer diameter of core wire are used. Thus, it is desirable that the crimp contact terminal should be used for crimping different types of electric wires.

To develop the described crimp contact terminal, a prototype of the designed crimp contact terminal is manufactured. The crimp contact terminal is actually crimped onto different types of electric wires, and whether the designed crimp contact terminal is good or bad is determined. Thus, the time period taken for developing the crimp contact terminal is prolonged and the developing cost is increased.

SUMMARY OF THE INVENTION

It is therefore an object of the invention to provide a crimp state estimation apparatus for a crimp contact terminal and a quality determination apparatus for a crimp contact terminal for making it possible to decrease the time period and the cost taken for developing the crimp contact terminal.

In order to solve the aforesaid object, the invention is characterized by having the following arrangement.

(1) A crimp state estimation apparatus for estimating a crimp state of a crimp contact terminal when the crimp contact terminal comprising a bottom wall for positioning a core wire of an electric wire and a pair of crimp pieces upright from opposite margins of the bottom wall and the core wire are held between an anvil and a crimper and are crimped, the crimp state estimation apparatus comprising:

an information input section for inputting information on the crimp contact terminal, the electric wire, the anvil, and the crimper and an input compression ratio of the core wire; and an estimation unit for calculating a total length of the bottom wall and the pair of crimp pieces after crimp in a cross section orthogonal to the core wire based on the information and the input compression ratio and estimating a cross-sectional shape of the bottom wall and the pair of crimp pieces after crimp based on the total length.

(2) The crimp state estimation apparatus according to (1) further comprising:

a calculation unit for calculating a calculated compression ratio of the core wire based on the information; and a crimp height calculation unit for finding spacing between the anvil and the crimper applied when a difference between the input compression ratio and the calculated compression ratio falls below a predetermined value.

(3) The crimp state estimation apparatus according to (2), wherein the calculation unit calculates a total cross-sectional area of the core wire, the bottom wall, and the pair of crimp pieces after crimp;

calculates a cross-sectional area of the crimp contact terminal after crimp;

calculates a cross-sectional area of the core wire after crimp based on the total cross-sectional area and the cross-sectional area of the crimp contact terminal; and calculates the calculated compression ratio of the core wire based on the cross-sectional area of the core wire and a cross-sectional area of the core wire before crimp input to the information input section.

(4) A quality determination apparatus for determining whether a crimp state of a crimp contact terminal is good or bad when the crimp contact terminal comprising a bottom wall for positioning a core wire of an electric wire and a pair of crimp pieces upright from opposite margins of the bottom wall and a core wire of an electric wire are held between an anvil and a crimper and are crimped, the quality determination apparatus comprising:

an information input section for inputting information on the crimp contact terminal, the electric wire, the anvil, and the crimper and an input compression ratio of the core wire of the electric wire;

a calculation unit for calculating a calculated compression ratio of the core wire based on the information;

an estimation unit for calculating a total length of the bottom wall and the pair of crimp pieces after crimp in a cross section orthogonal to the core wire based on the input compression ratio and estimating a cross-sectional shape of the bottom wall and the pair of crimp pieces after crimp based on the total length;

a crimp height calculation unit for finding spacing between the anvil and the crimper applied when a difference between the input compression ratio and the calculated compression ratio of the core wire of the electric wire falls below a predetermined value; and a determination unit for determining the crimp state of the crimp contact terminal based on the cross-sectional shape estimated by the estimation unit in the spacing found by the crimp height calculation unit.

(5) The quality determination apparatus according to (4), wherein in the cross-sectional shape estimated by the estimation unit in the spacing found by the crimp height calculation unit, if the total length is equal to or greater than a length applied when the pair of crimp pieces comes in contact with each other and is less than a length applied when the pair of crimp pieces comes in contact with the bottom wall, the determination unit determines that the crimp state of the crimp contact terminal is good; and if the total length is less than the length applied when the pair of crimp pieces comes in contact with each other or is equal to or greater than the length applied when the pair of crimp pieces comes in contact with the bottom wall, the determination unit determines that the crimp state of the crimp contact terminal is bad.

(6) The quality determination apparatus according to (4), wherein the calculation unit calculates a total cross-sectional area of the core wire, the bottom wall, and the pair of crimp pieces in the orthogonal direction to the core wire after crimp;

calculates a cross-sectional area of the crimp contact terminal after crimp;

calculates a cross-sectional area of the core wire after crimp based on the total cross-sectional area and the cross-sectional area of the crimp contact terminal; and calculates the calculated compression ratio of the core wire based on the cross-sectional area of the core wire and a cross-sectional area of the core wire before crimp input to the information input section.

DETAILED DESCRIPTION OF PREFERRED EMBODIMENTS

Figure 11:
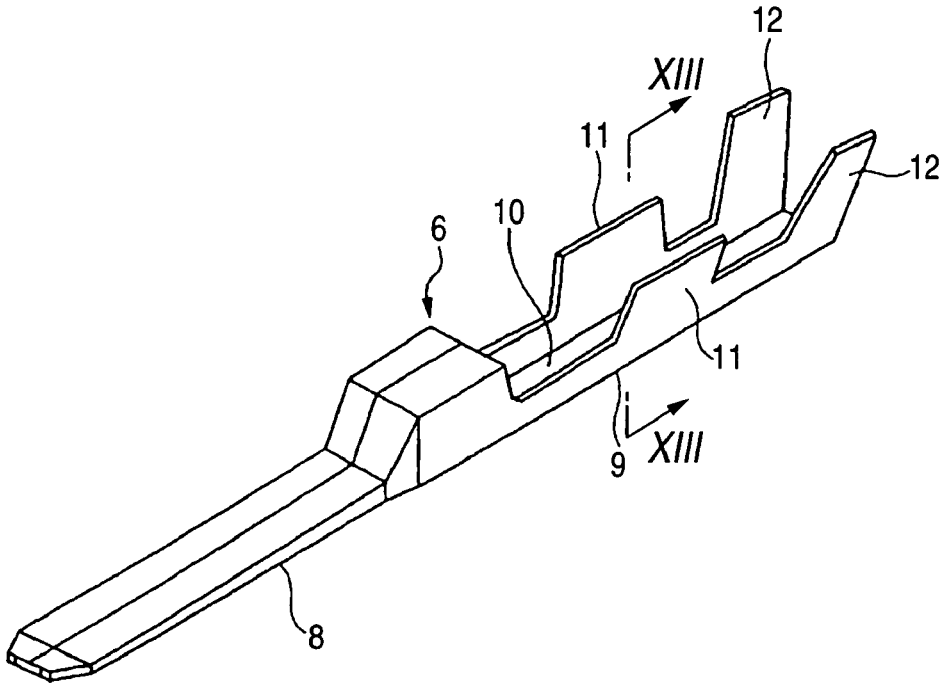
FIG. 11 is a perspective view to show an example of the crimp contact terminal estimated and determined in the estimation and determination system shown in FIG. 1.

A crimp state estimation apparatus for a crimp contact terminal and a quality determination apparatus for a crimp contact terminal, which will be hereinafter referred to as simply the estimation and determination system, 1 according to one embodiment of the invention will be described with reference to FIGS. 1 to 24. The estimation and determination system 1 shown in FIG. 1, etc., is a system for estimating the crimp state when a crimp contact terminal 6 shown in FIG. 11 is crimped onto an electric wire 2 shown in FIG. 14, and determining whether the estimated crimp state is good or bad, namely, the crimp contact terminal 6 is good or bad.

Figure 14:
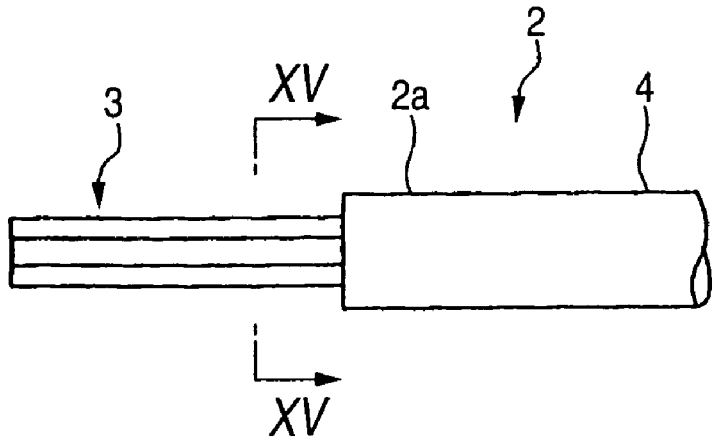
FIG. 14 is a side view to show an example of an electric wire on which the crimp contact terminal shown in FIG. 11 is crimped.
Figure 15:
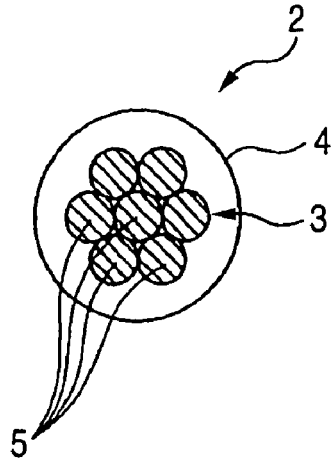
FIG. 15 is a sectional view taken on line XV—XV in FIG. 14.

The electric wire 2 includes a conductive core wire 3 and an insulating sheath 4, as shown in FIGS. 14 and 15. The core wire 3 is made up of a plurality of element wires 5. In the example in the figures, seven element wires 5 are provided. Each element wire 5 is made of electrically conductive metal such as copper. The element wire 5 is circular in cross section. The plurality of element wires 5 are bundled to form the core wire 3.

The sheath 4 is made of an insulating synthetic resin for covering the element wires 3. The sheath 4 is annular in cross section. The electric wire 2 includes the core wire 3 and the sheath 4 and is circular in cross section. The sheath 4 is removed at a terminal 2*a* of the electric wire 2 to expose the core wire 3.

Figure 12:
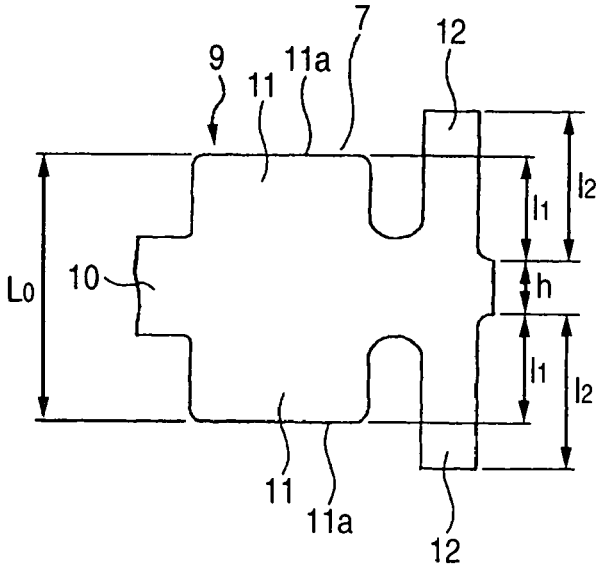
FIG. 12 is a developed view of an electric wire connection part of the crimp contact terminal shown in FIG. 11.

The crimp contact terminal 6 is implemented as a conductive metal sheet 7, a part of which is shown in FIG. 12. The crimp contact terminal 6 is provided by bending the metal sheet 7, a part of which is shown in FIG. 12. The crimp contact terminal 6 includes an electric contact part 8 and an electric wire connection part 9 in one piece, as shown in FIG. 11. The electric contact part 8 electrically connects to a mated terminal fitment.

Figure 13:
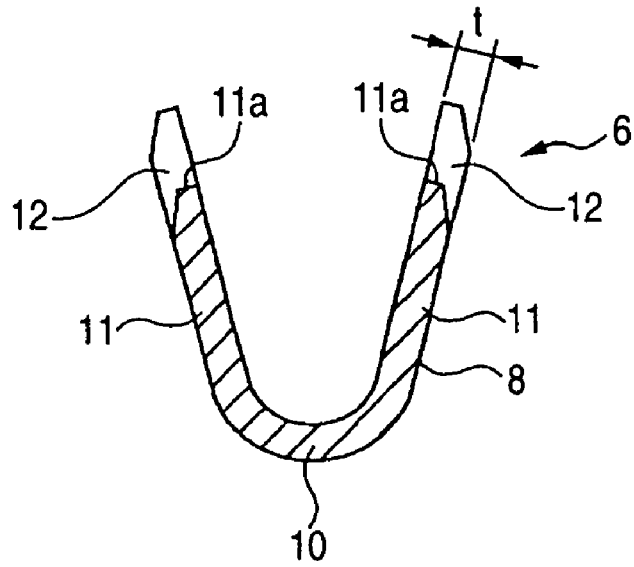
FIG. 13 is a sectional view taken on line XIII—XIII in FIG. 11.

The electric wire connection part 9 includes a bottom wall 10 for positioning the core wire 3 of the electric wire 2 on a surface, a pair of core wire crimp pieces 11, and a pair of sheath crimp pieces 12, as shown in FIGS. 12 and 13. The bottom wall 10 is formed like a roughly flat belt plate. The pair of core wire crimp pieces 11 is upright from opposite margins of the bottom wall 10 in the width direction thereof. The paired core wire crimp pieces 11 face each other with a spacing.

Figure 16:
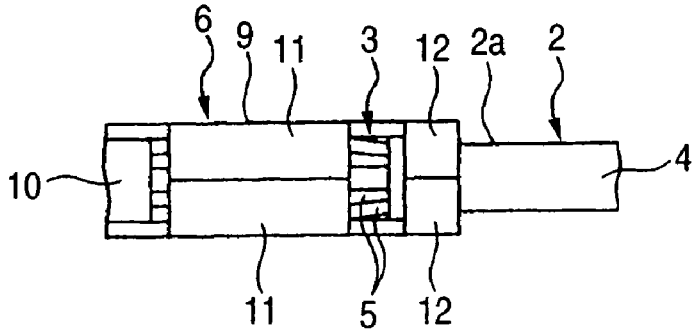
FIG. 16 is a plan view to show a state in which the electric wire connection part of the crimp contact terminal shown in FIG. 11 is crimped on the electric wire.
Figure 17:
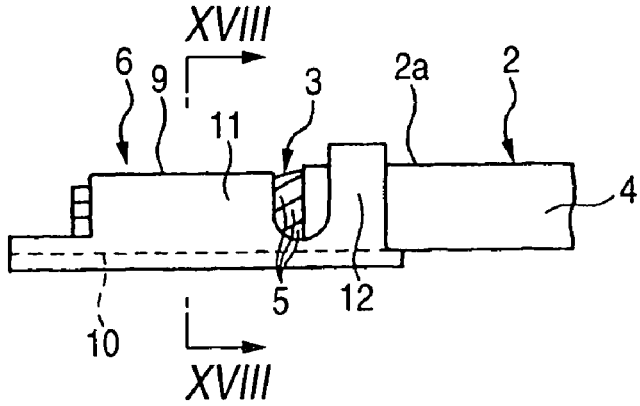
FIG. 17 is a side view of the electric wire connection part of the crimp contact terminal shown in FIG. 16 on which the electric wire1 is crimped.
Figure 18:
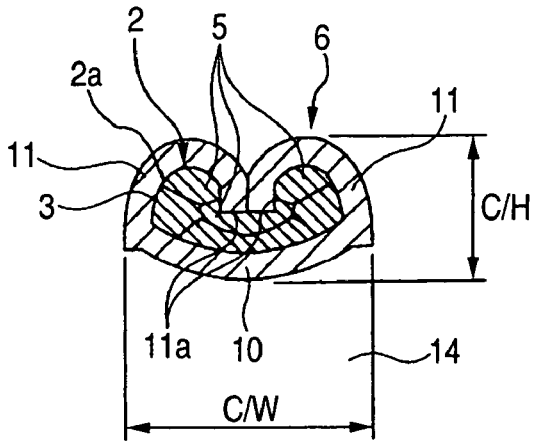
FIG. 18 is a sectional view taken on line XIII—XIII in FIG. 17.

The pair of core wire crimp pieces 11 is bent toward the bottom wall 10, thereby crimping the core wire 3 exposed at the terminal 2*a* in the bottom wall 10, as shown in FIGS. 16 to 18. Thus, the core wire crimp pieces 11 crimp the core wire 3. The core wire crimp pieces 11 are crimp pieces described in the specification.

The pair of sheath crimp pieces 12 is upright from opposite margins of the bottom wall 10 in the width direction thereof. The sheath crimp pieces 12 are more distant from the electric contact part 8 than the core wire crimp pieces 11. The paired sheath crimp pieces 12 face each other with a spacing. The pair of sheath crimp pieces 12 is bent toward the bottom wall 10, thereby crimping the sheath 4 at the terminal 2*a*, namely, the electric wire 2 in the bottom wall 10, as shown in FIGS. 16 and 17. Thus, the sheath crimp pieces 12 crimp the sheath 4, namely, the electric wire 2.

Figure 19:
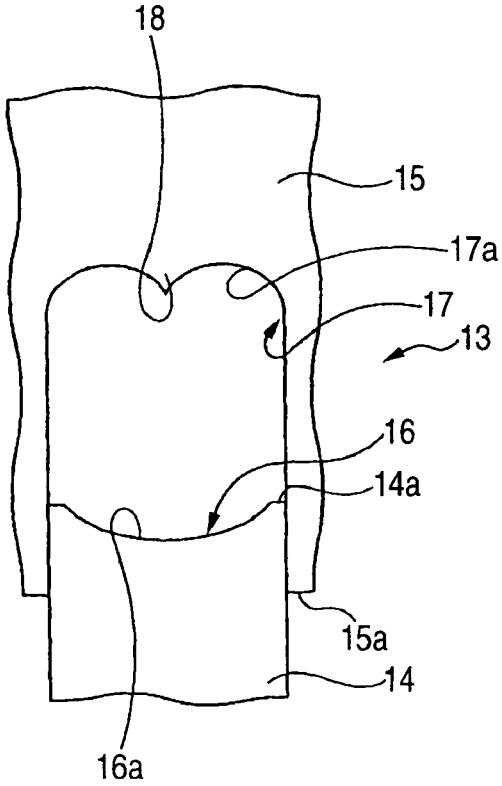
FIG. 19 is a front view to show the main part of a crimp unit for crimping the electric wire connection part of the crimp contact terminal shown in FIG. 11 on the electric wire.
Figure 20:
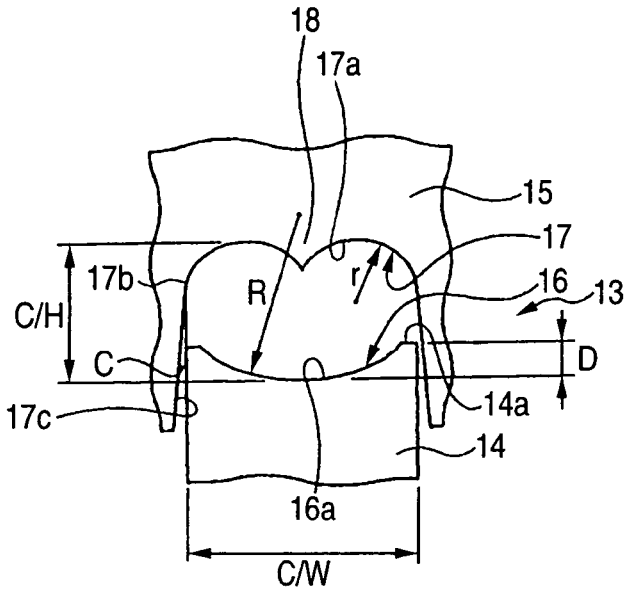
FIG. 20 is a front view to show a state in which an anvil and a crimper of the crimp unit shown in FIG. 19 are closest to each other.

As to the crimp contact terminal 6, a crimp unit 13 shown in FIGS. 19 and 20 is used to bent the crimp pieces 11 and 12 toward the bottom wall 10 with in a state that the core wire 3 exposed at the terminal 2*a* and the sheath 4 are placed on the bottom wall 10, whereby the electric wire 2 is attached. Thus, the crimp contact terminal 6 is crimped onto the electric wire 2.

When the crimp contact terminal 6 is crimped onto the electric wire 2, the electric wire connection part 9 of the crimp contact terminal 6 and the core wire 3 of the electric wire 2 are electrically connected and the electric wire connection part 9 and the core wire 3 of the electric wire 2 are compressed. That is, when the crimp contact terminal 6 is crimped onto the electric wire 2, the cross-sectional area of the bottom wall 10 and the pair of core wire crimp pieces 11 orthogonal to the core wire 3 decreases and the cross-sectional area of the core wire 3 also decreases.

If the crimp contact terminal 6 is normally crimped onto the electric wire 2, namely, if the crimp state of the crimp contact terminal 6 onto the electric wire 2 is good, the paired core wire crimp pieces 11 are in contact with each other and are spaced from the bottom wall 10, as shown in FIG. 18. That is, in the crimp contact terminal 6 in the good crimp state, the core wire crimp pieces 11 are not in contact with the bottom wall 10.

Figure 23:
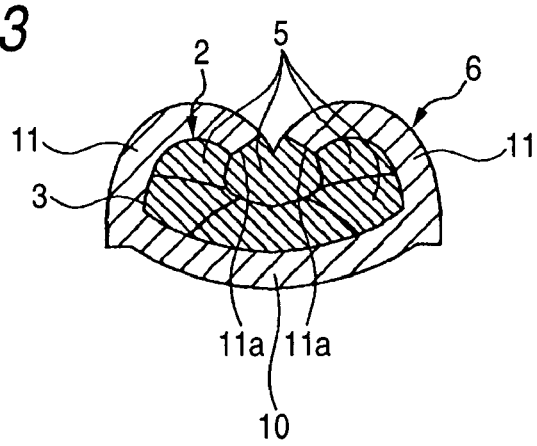
FIG. 23 is a sectional view to show an example of a crimp failure of the crimp contact terminal shown in FIG. 18.
Figure 24:
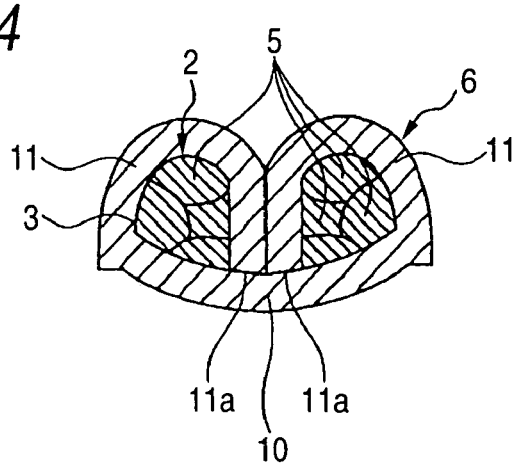
FIG. 24 is a sectional view to show another example of a crimp failure of the crimp contact terminal shown in FIG. 18.

On the other hand, if the crimp contact terminal 6 is abnormally crimped onto the electric wire 2, namely, if the crimp state of the crimp contact terminal 6 onto the electric wire 2 is bad, the paired core wire crimp pieces 11 may be out of contact with each other, as shown in FIG. 23. Further, if the crimp state of the crimp contact terminal 6 onto the electric wire 2 is bad, the paired core wire crimp pieces 11 may be in contact with each other and be in contact with the bottom wall 10, as shown in FIG. 24.

In the electric wire connection part 9, a projection amount (length) $l_1$ of the core wire crimp piece 11 from the bottom wall 10 is smaller (shorter) than a projection amount (length) 12 of the sheath crimp piece 12 from the bottom wall 10 in the state of the metal sheet 7 before being bent, as shown in FIG. 12. Incidentally, the length $l_1$ of the core wire crimp piece 11 is the length of the core wire crimp piece 11 in the orthogonal direction to the length direction of the electric wire 2, namely, the core wire 3 (the width direction of the bottom wall 10).

Sum L0 of the lengths $l_1$ of the pair of core wire crimp pieces 11 and a width h of the bottom wall 10 in the orthogonal direction to the length direction of the electric wire 2, namely, the core wire 3 means the total length of the bottom wall 10 and the pair of core wire crimp pieces 11 in the cross section orthogonal to the core wire 3 described in the specification and will be hereinafter referred to as the wire barrel length. Further, the wire barrel length L0 means the wire barrel length before the crimp contact terminal 6 is crimped onto the electric wire 2. Total length L1 (shown in FIG. 8) of the bottom wall 10 and the pair of core wire crimp pieces 11 in the cross section orthogonal to the core wire 3 after the crimp contact terminal 6 is crimped onto the electric wire 2 is also referred to as the wire barrel length.

The crimp unit 13 includes an anvil 14 and a crimper 15 opposed to each other, as shown in FIGS. 19 and 20. A recess part 16 is formed on an end face 14*a* of the anvil 14 opposed to the crimper 15. The recess part 16 is dented from the end face 14*a*. A surface (inner face) 16*a* of the recess part 16 is formed like a circular arc in cross section. The anvil 14 positions the crimp contact terminal 6 and the electric wire 2 on the inner face 16*a* of the recess part 16.

The crimper 15 is supported so that it can be brought toward or away from the anvil 14. The crimper 15 is controlled so as to be brought toward and away from the anvil 14 by a drive unit (not shown) between the positions shown in FIGS. 19 and 20.

A recess part 17 is formed on an end face 15*a* of the crimper 15 opposed to the anvil 14. The recess part 17 is dented from the end face 15*a*. A convex projection 18 is provided from an inner face 17*a* of the recess part 17. The recess part 17 is formed with the projection 18 at the center in the width direction of the electric wire 2 positioned on the inner face 16*a* of the recess part 16 of the anvil 14. The inner face 17*a* is constituted by two substantially circular arcs in cross section, one being from one outer margin of the recess part 17 to the projection 18 and the other being from an opposite outer margin of the recess part 17 to the projection 18. On the inner face 17*a* of the recess part 17, the projection 18 forms a ridgeline.

Figure 21:
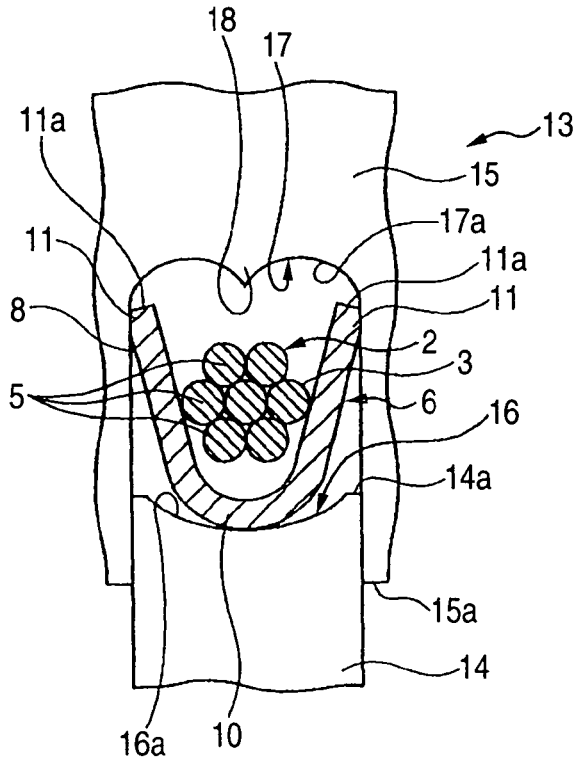
FIG. 21 is a front view to show a state in which the electric wire connection part of the crimp contact terminal and the core wire of the electric wire are positioned between the anvil and the crimper of the crimp unit shown in FIG. 19.

In the crimp unit 13 described above, the tip of the anvil 14 is housed in the recess part 17 of the crimper 15. The anvil 14 and the crimper 15 are brought away from each other with the tip of the anvil 14 housed in the recess part 17 of the crimper 15. The crimp unit 13 positions the crimp contact terminal 6 on the inner face 16*a* of the recess part 16 of the anvil 14 and the core wire 3 of the electric wire 2 on the bottom wall 10 of the crimp contact terminal 6 in a state in which the crimper 15 is most away from the anvil 14, as shown in FIG. 21.

Figure 22:
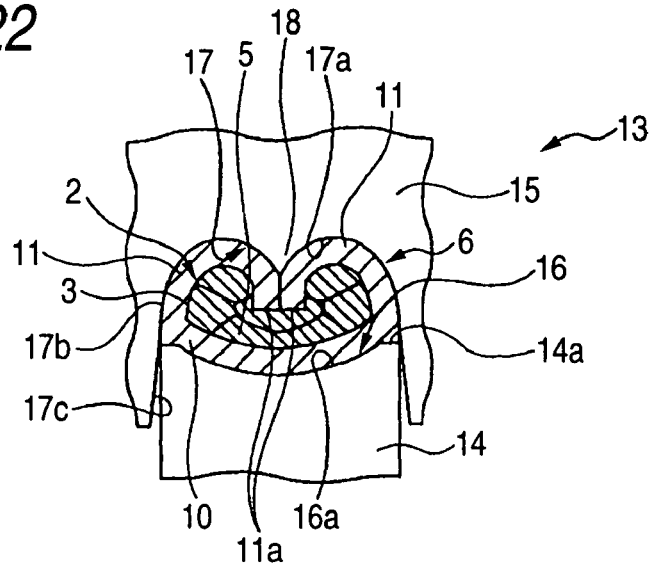
FIG. 22 is a front view to show a state in which the anvil and the crimper shown in FIG. 21 are brought close to each other for crimping the electric wire connection part of the crimp contact terminal on the core wire of the electric wire.

In the crimp unit 13, the crimper 15 is brought close to the anvil 14 and bends the bottom wall 10 and the pair of core wire crimp pieces 11 along the inner faces 16*a* and 17*a* of the recess parts 16 and 17, as shown in FIG. 22. Thus, the crimp unit 13 crimps the core wire 3 with the core wire crimp pieces 11 for crimping the crimp contact terminal 6 onto the electric wire 2.

As shown in FIG. 20, in the state in which the anvil 14 and the crimper 15 are closest to each other, the spacing between the bottom of the inner face 16*a* of the recess part 16 of the anvil 14 and the bottom of the inner face 17*a* of the recess part 17 of the crimper 15 is set in the height of the crimp part of the crimp contact terminal 6 crimped on the electric wire 2 and means the spacing between the anvil 14 and the crimper 15 described in the specification, which will be hereinafter referred to as the crimp height (C/H). The width in the width direction of the electric wire 2 positioned on the inner face 16*a* of the recess part 16 of the anvil 14 will be hereinafter referred to as the crimp width (C/W).

Figure 1:
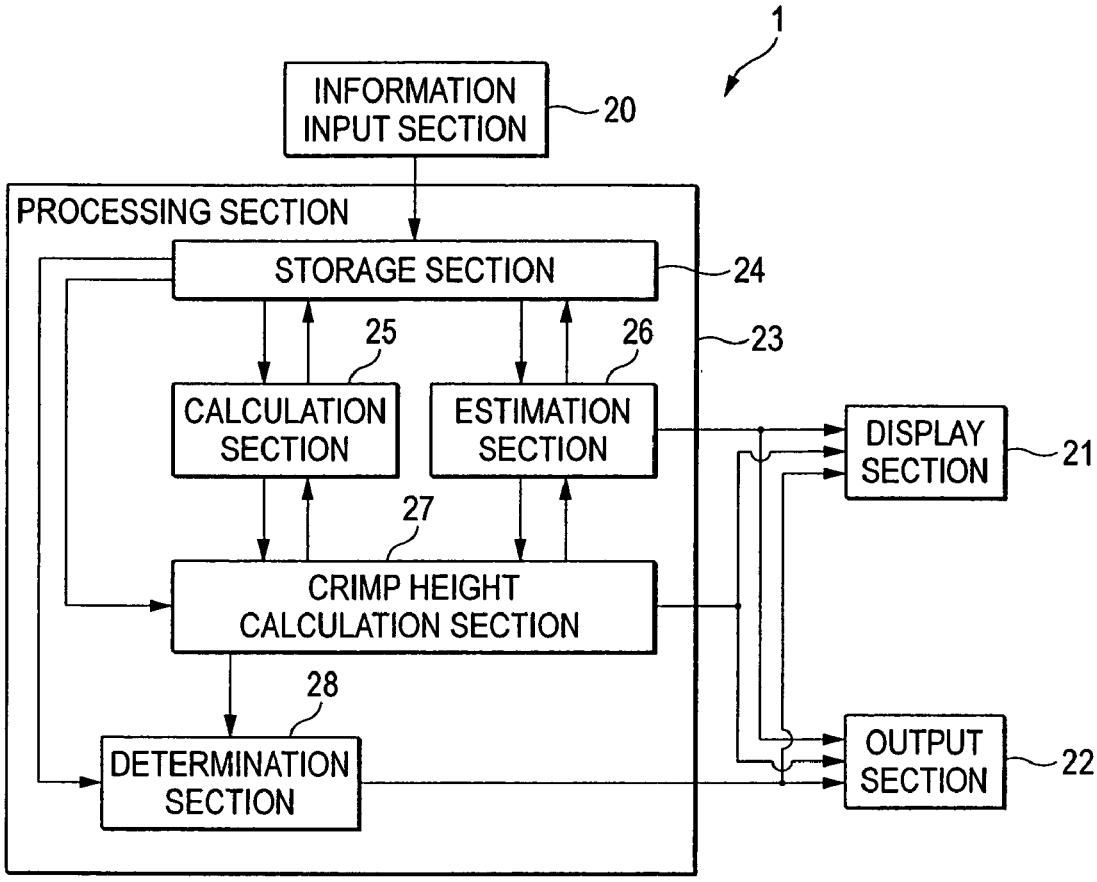
FIG. 1 is a block diagram to show the configuration of an estimation and determination system according an embodiment of the invention.
Figure 2:
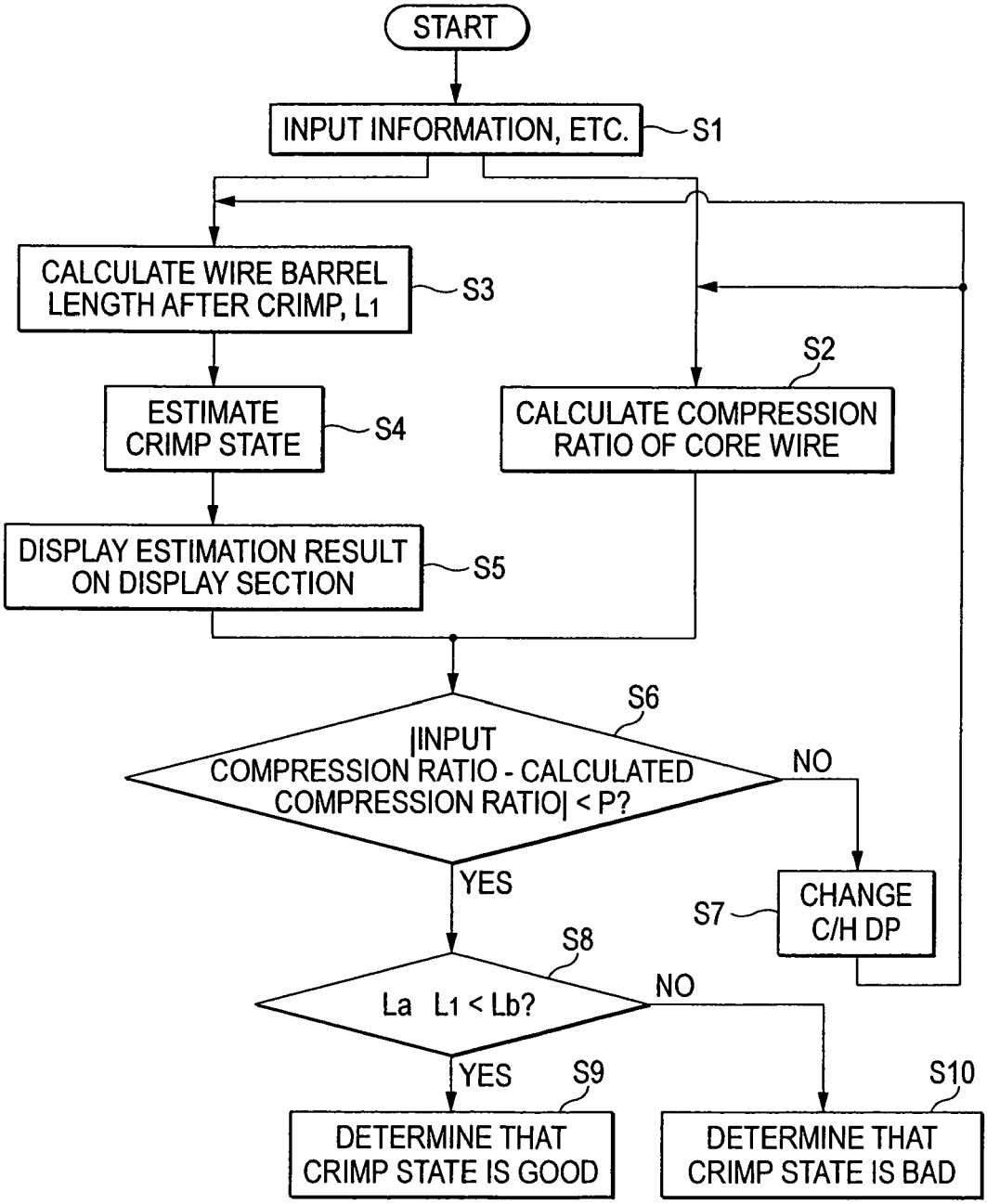
FIG. 2 is a flowchart to show the process for the estimation and determination system shown in FIG. 1 to estimate the crimp state of a crimp contact terminal and determine whether the crimp contact terminal is good or bad.

The estimation and determination system 1 shown in FIG. 1 estimates the cross-sectional shape of the core wire crimp pieces 11 of the crimp contact terminal 6 after crimp orthogonal to the core wire 3 of the electric wire 2 without actually crimping the crimp contact terminal 6 onto the electric wire 2 with the crimp unit 13. The estimation and determination system 1 determines whether the crimp state is good or bad, namely, the crimp contact terminal 6 is good or bad based on the estimated cross-sectional shape of the core wire crimp pieces 11. To estimate the cross-sectional shape of the core wire crimp pieces 11 orthogonal to the core wire 3 of the electric wire 2 means to estimate the crimp state in the specification.

The estimation and determination system 1 includes an information input section 20, a display section 21, an output section 22, and a processing unit 23 shown in FIG. 1.

The information input section 20 is used to input information on the crimp contact terminal 6 and the electric wire 2 whose crimp state is to be estimated and information on the anvil 14 and the crimper 15 used to crimp the crimp contact terminal 6 onto the electric wire 2 into the processing unit 23. Thickness t of the metal plate 7 forming the crimp contact terminal 6 before crimp, namely, thickness t of the core wire crimp piece 11 before crimp (shown in FIG. 13, etc.,) is used as the information on the crimp contact terminal 6 whose crimp state is to be estimated. The above-described wire barrel length L0 of the crimp contact terminal 6 before crimp is used as the information on the crimp contact terminal 6.

Sum Sd0 of the cross-sectional areas of all element wires 5 of the core wire 3 of the electric wire 2 before crimp, hatched in FIG. 15 is used as the information on the electric wire 2 whose crimp state is to be estimated. The sum Sd0 of the cross-sectional areas of all element wires 5 will be hereinafter referred to as the conductor cross-sectional area. The crimp width C/W is used as the information on the anvil 14 and the crimper 15 used to crimp the crimp contact terminal 6 onto the electric wire 2.

Curvature radius R of the recess part 16 of the anvil 14 (shown in FIG. 20), depth D of the recess part 16 of the anvil 14 (shown in FIG. 20), and curvature radius r and aperture angle C of the recess part 17 of the crimper 15 (both shown in FIG. 20) are used as the information on the anvil 14 and the crimper 15. Estimated (aimed) crimp height C/H is used as the information on the anvil 14 and the crimper 15. The depth D of the recess part 16 represents the distance from the end face 14*a* to the bottom of the recess part 16. The aperture angle C represents the angle between the vertical direction and a linear section 17*c* at an intersection point 17*b* of the inner face 17*a* of the recess part 17 and the flat linear section 17*c* when the anvil 14 and the crimper 15 approach each other and crimp the crimp contact terminal 6 onto the electric wire 2.

Further, the information input section 20 is used to input ratio A0 of the estimated (aimed) conductor cross-sectional area Sd after crimp to the conductor cross-sectional area Sd0 before crimp into the processing unit 23. The ratio A0 will be hereinafter referred to as the input compression ratio.

Thus, the information input section 20 is used to input the thickness t of the core wire crimp piece 11 before crimp, the wire barrel length L0 before crimp, the conductor cross-sectional area Sd0 before crimp, the crimp width C/W, the curvature radiuses R and r, the aperture angle C, the depth D, the crimp height C/H, and the input compression ratio A0 into the processing unit 23.

The information input section 20 is also used for the user to operate the estimation and determination system 1. A known keyboard, mouse, switches, buttons, and the like can be used as the information input section 20. Further, a storage unit such as a CD-ROM drive storing, as electronic information, the information responsive to the thickness t, the wire barrel length L0 before crimp, the conductor cross-sectional area Sd0 before crimp, the crimp width C/W, the curvature radiuses R and r, the aperture angle C, the depth D, the crimp height C/H, and the input compression ratio A0 may be used as the information input section 20.

The display section 21 displays the operation status of the estimation and determination system 1, the estimation result of the estimation and determination system 1, namely, the cross-sectional shape of the core wire crimp pieces 11 of the crimp contact terminal 6, whether the crimp contact terminal 6 is good or bad, the crimp height C/H calculated by a crimp height calculation section 27 (described later), and the like. A display such as a known CRT (cathode-ray tube) or liquid crystal display can be used as the display section 21.

The output section 22 outputs the estimation result of the estimation and determination system 1, namely, the cross-sectional shape of the core wire crimp pieces 11 of the crimp contact terminal 6, whether the crimp contact terminal 6 is good or bad, the crimp height C/H calculated by the crimp height calculation section 27, and the like. A known printer for printing the estimation result, the determination result, etc., a CD-ROM drive capable of writing, as electronic information, the estimation result, the determination result, etc., to record media such as a CD-ROM, or the like can be used as the output section 22.

The processing unit 23 is a known computer including a CPU (central processing unit), ROM (read-only memory), and RAM (random access memory). The processing unit 23 includes a storage section 24, a calculation section 25, an estimation section 26, the above-mentioned crimp height calculation section 27, and a determination section 28, as shown in FIG. 1.

The storage section 24 stores a program for the estimation and determination system 1 to operate and the like. The storage section 24 once stores the information responsive to the thickness t, the wire barrel length L0 before crimp, the conductor cross-sectional area Sd0 before crimp, the crimp width C/W, the curvature radiuses R and r, the crimp height C/H, and the input compression ratio A0 input from the information input section 20.

Further, the storage section 24 once stores the information responsive to compression ratio y of the crimp contact terminal 6 calculated by the calculation section 25. The storage section 24 once stores wire barrel length La (shown in FIG. 9) when margins 11*a* (most distant from the bottom wall 10, shown in FIG. 13, etc.,) of the pair of core wire crimp pieces 11 calculated by the estimation section 26 come in contact with each other. The wire barrel length La is the length applied when the core wire crimp pieces 11 are in contact with each other.

The storage section 24 once stores wire barrel length Lb (shown in FIG. 10) when the margins 11*a* of the pair of core wire crimp pieces 11 calculated by the estimation section 26 come in contact with the bottom wall 10. The wire barrel length Lb is the length applied when the core wire crimp pieces 11 are in contact with the bottom wall 10. The storage section 24 once stores the wire barrel length L1 after crimp calculated by the estimation section 26.

The calculation section 25 calculates compression ratio A1 of the core wire 3 of the electric wire 2, which will be hereinafter referred to as the calculated compression ratio, based on the information responsive to the crimp height C/H, the crimp width C/W, the curvature radiuses R and r, the wire barrel length L0 before crimp, the thickness t, the input compression ratio A0, and the conductor cross-sectional area Sd0 before crimp, stored in the storage section 24. The calculated compression ratio A1 represents the ratio of the sum Sd of the cross-sectional areas of all element wires 5 of the core wire 3 after crimp to the sum Sd0 of the cross-sectional areas of all element wires 5 of the core wire 3 before crimp.

Figure 3:
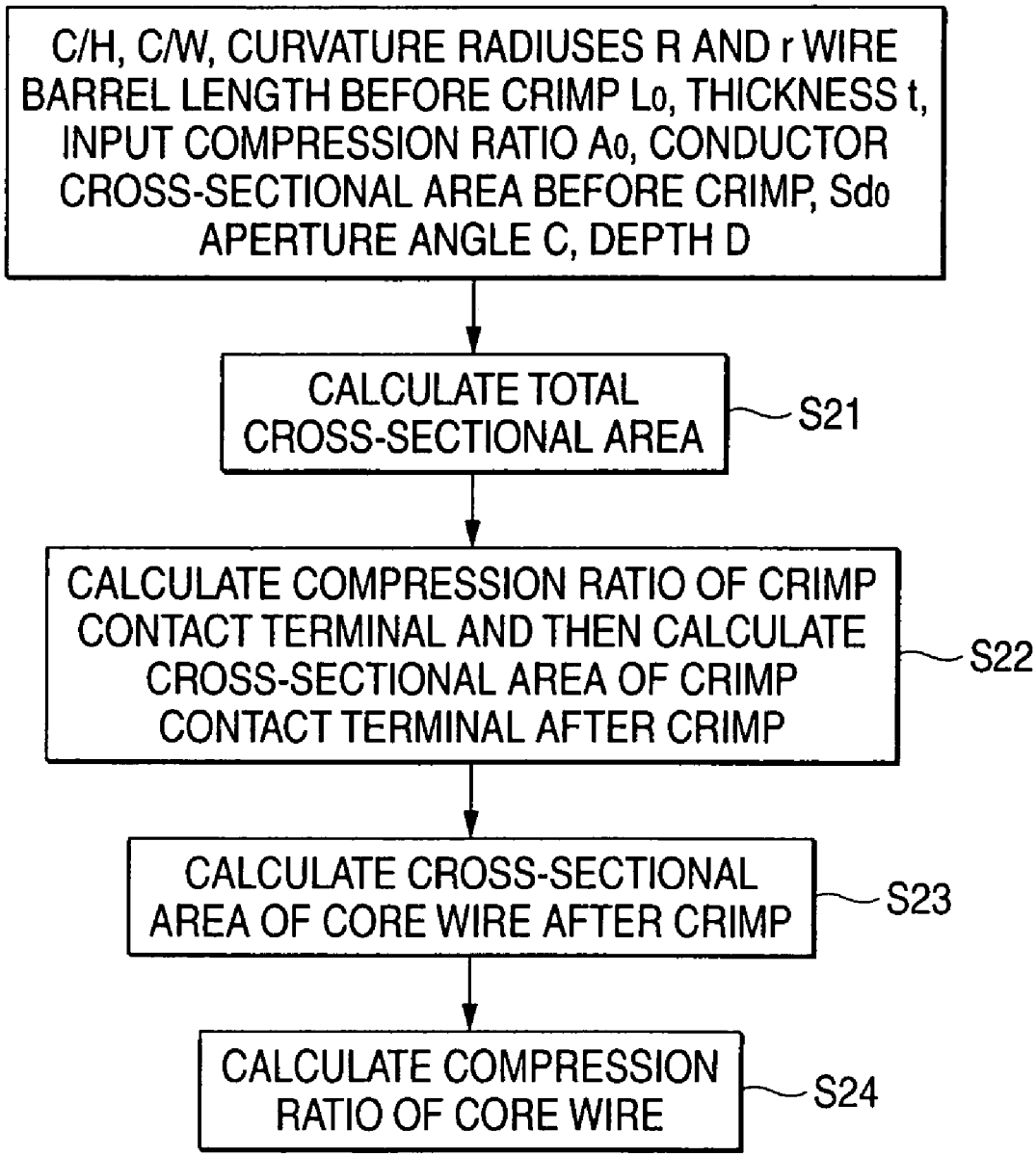
FIG. 3 is a flowchart to show a flow in step S2 in FIG. 2.

To calculate the calculated compression ratio A1, first at step S21 in FIG. 3, the calculation section 25 calculates the cross-sectional area S0 of space K (hatched in FIG. 5) surrounded by the inner faces 16*a* and 17*a* of the recess parts 16 and 17 with the anvil 14 and the crimper 15 closest to each other based on the crimp height C/H, the crimp width C/W, the curvature radiuses R and r, etc.

Figure 5:
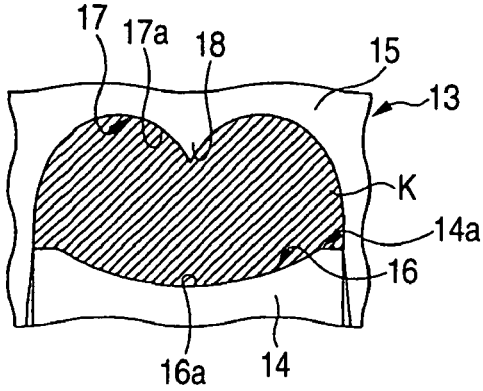
FIG. 5 is a schematic representation to show the total cross-sectional area calculated at step S21 in FIG. 3.

That is, the cross-sectional area S0 of the space K hatched in FIG. 5 is calculated. This cross-sectional area S0 will be hereinafter referred to as the total cross-sectional area. The total cross-sectional area S0 is the total cross-sectional area of the core wire 3 of the electric wire 2, the bottom wall 10, and the pair of core wire crimp pieces 11 after crimp. After calculating the total cross-sectional area S0, the calculation section 25 proceeds to step S22.

Figure 6:
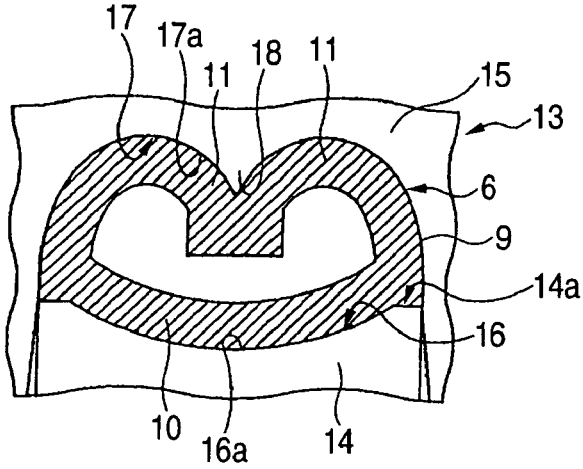
FIG. 6 is a schematic representation to show the cross-sectional area of a crimp contact terminal after crimp calculated at step S22 in FIG. 3.

At step S22, the calculation section 25 calculates the compression ratio y of the crimp contact terminal 6 using the following expression 1 and then uses the compression ratio y and the following expression 2 to calculate cross-sectional area St of the bottom wall 10 and the pair of core wire crimp pieces 11 after crimp, namely, the cross-sectional area St of the crimp contact terminal 6 after crimp (hatched in FIG. 6).

The compression ratio y of the crimp contact terminal 6 indicates the ratio of the cross-sectional area of the bottom wall 10 and the pair of core wire crimp pieces 11 after crimp to the cross-sectional area of the bottom wall 10 and the pair of core wire crimp pieces 11. The cross section of the bottom wall 10 and the pair of core wire crimp pieces 11 after crimp is hatched in FIG. 6. That is, the compression ratio y indicates the ratio of the cross-sectional area of the crimp contact terminal 6 after crimp to the cross-sectional area of the crimp contact terminal 6 before crimp.

$$y=a\times A0+b \qquad \text{Expression 1}$$

where a and b are constants determined according to the material, etc., of the crimp contact terminal 6.

$$St=t\times L0\times y \qquad \text{Expression 2}$$

After calculating the cross-sectional area St of the crimp contact terminal 6 after crimp, the calculation section 25 proceeds to step S23.

Figure 7:
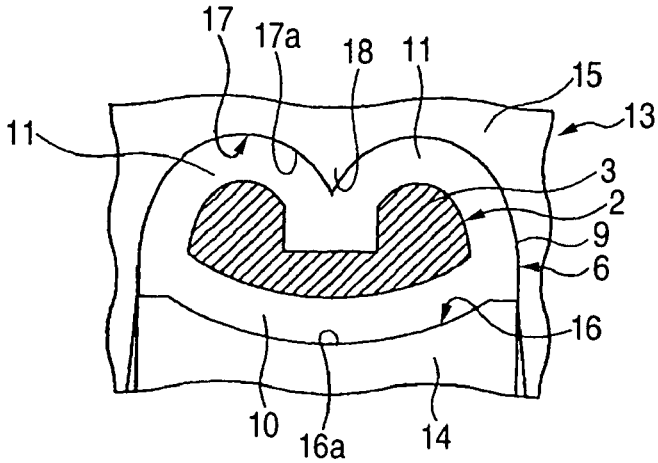
FIG. 7 is a schematic representation to show the cross-sectional area of a core wire after crimp calculated at step S23 in FIG. 3.
Figure 8:
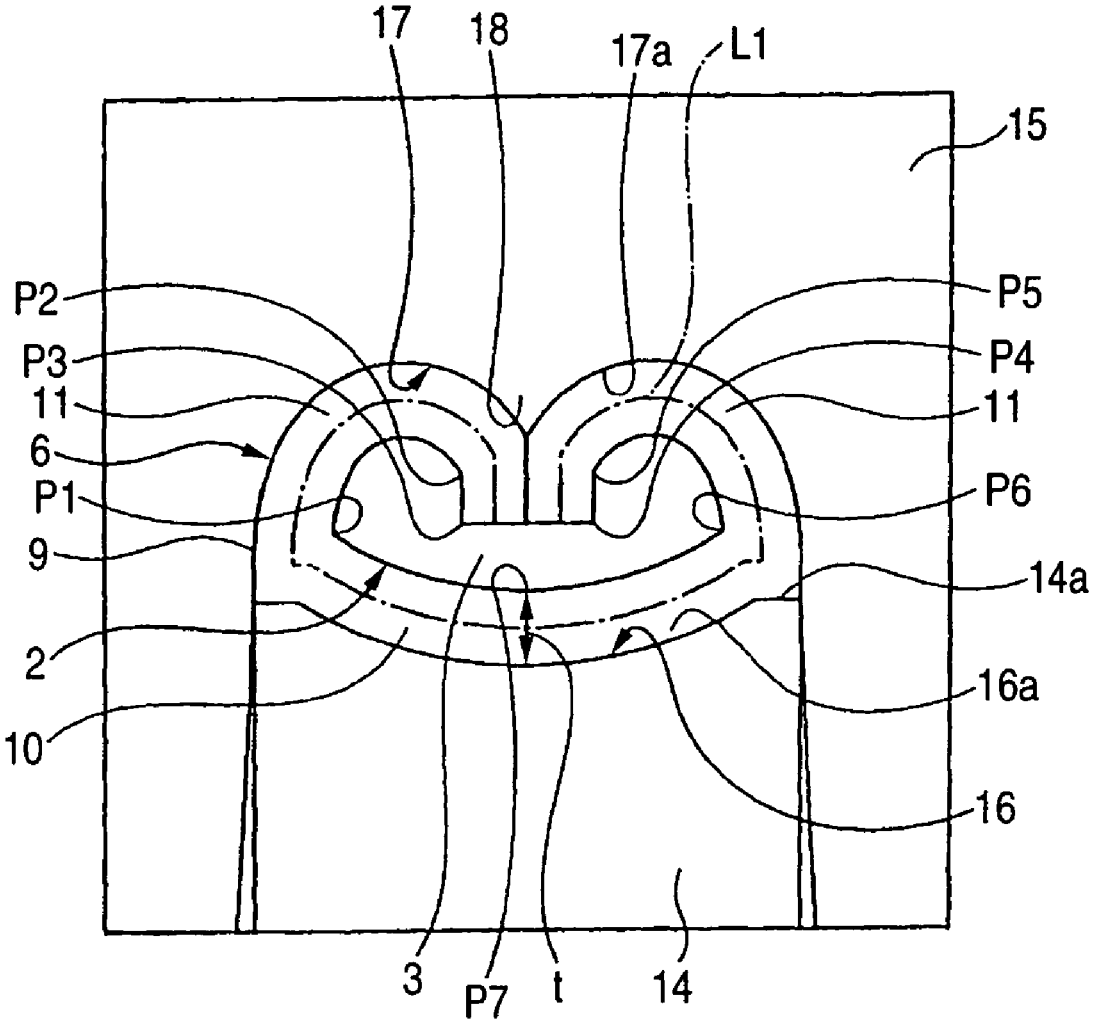
FIG. 8 is a schematic representation to show the cross-sectional shape of the crimp contact terminal estimated at step S41 in FIG. 4.
Figure 9:
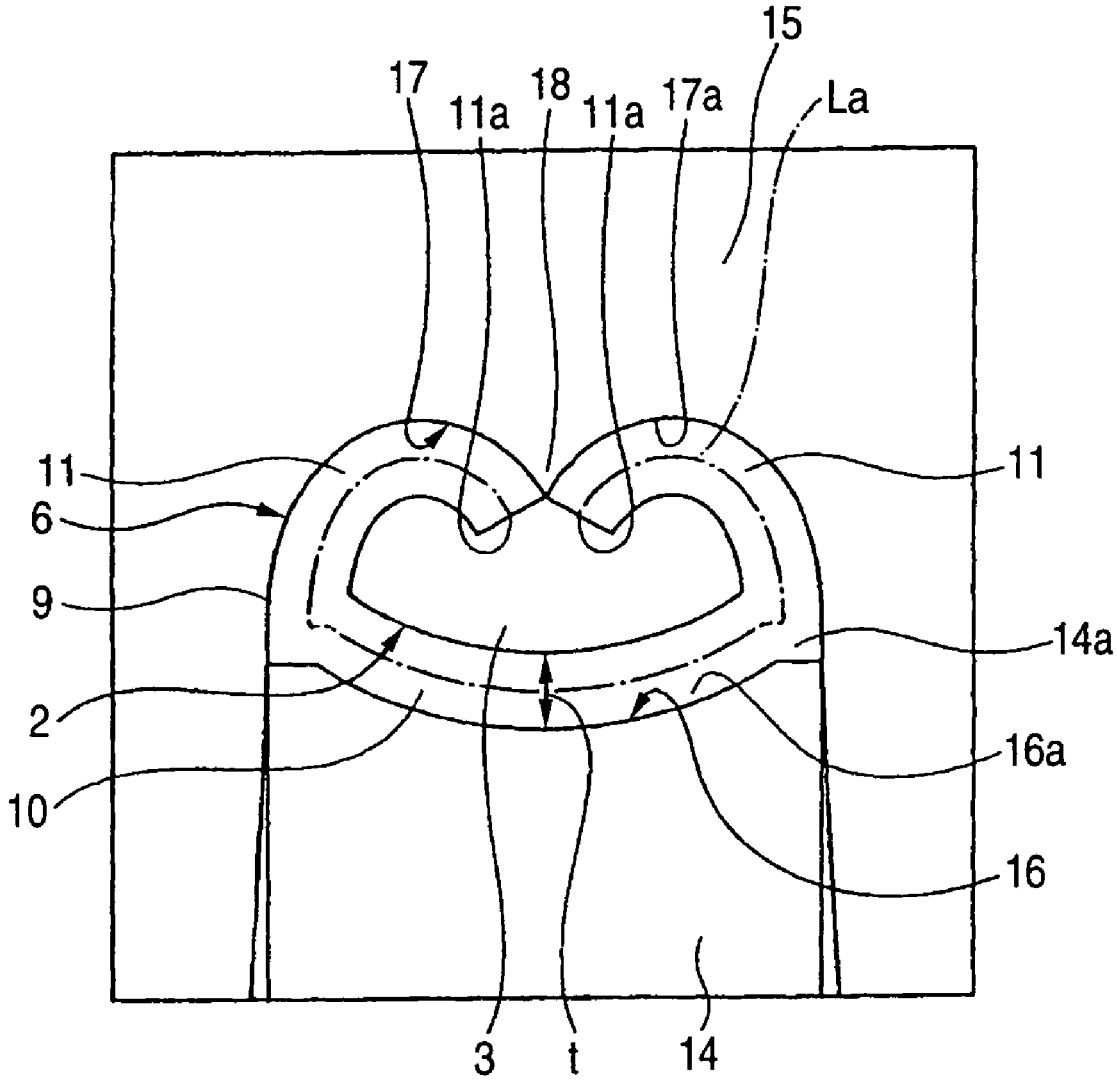
FIG. 9 is a schematic representation to show the wire barrel length, etc., when margins of a pair of core wire crimp pieces come in contact with each other, calculated at step S42 in FIG. 4.
Figure 10:
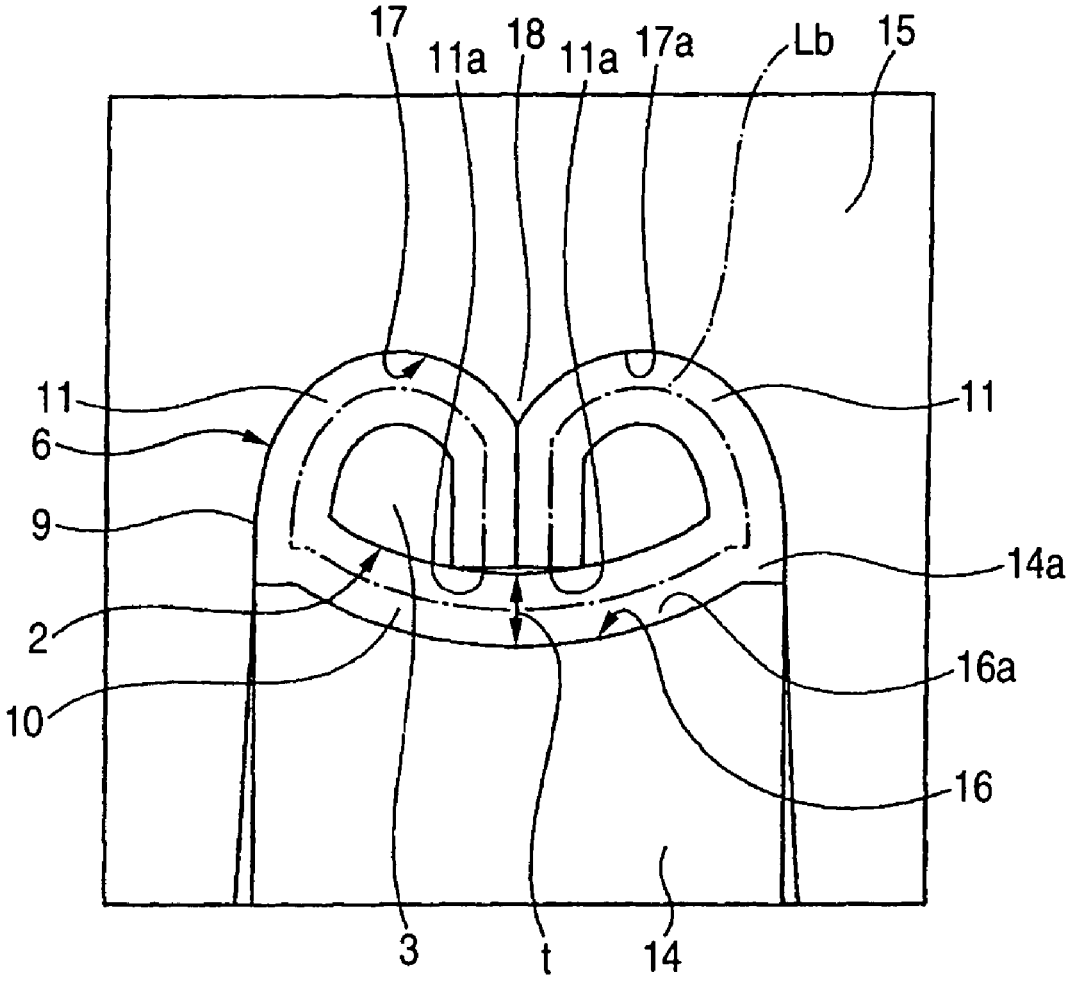
FIG. 10 is a schematic representation to show the wire barrel length, etc., when the margins of the pair of core wire crimp pieces come in contact with a bottom wall, calculated at step S43 in FIG. 4.

At step S23, the calculation section 25 uses the total cross-sectional area S0, the cross-sectional area St of the crimp contact terminal 6, and the following expression 3 to calculate the cross-sectional area of the core wire 3 after crimp, namely, the conductor cross-sectional area Sd (hatched in FIG. 7). The cross section of the core wire 3 is hatched in FIG. 7.

$$Sd=S0-St \qquad \text{Expression 3}$$

After calculating the conductor cross-sectional area Sd after crimp, the calculation section 25 proceeds to step S24.

At step S24, the calculation section 25 uses the conductor cross-sectional area Sd after crimp, the conductor cross-sectional area Sd0 before crimp, and the following expression 4 to calculate the compression ratio A1 of the core wire 3, namely, find the calculated compression ratio A1:

$$A1=Sd/Sd0 \qquad \text{Expression 4}$$

Thus, the calculation section 25 finds the compression ratio A1 of the core wire 3 of the electric wire 2 after crimp, namely, the calculated compression ratio A1 based on the information stored in the storage section 24, namely, the information input from the information input section 20. The calculation section 25 outputs the information responsive to the compression ratio y of the crimp contact terminal 6 calculated using expression 1 to the storage section 24. Further, the calculation section 25 outputs the calculated compression ratio A1 found as described above to the crimp height calculation section 27.

The estimation section 26 calculates the wire barrel length L1 after crimp based on the wire barrel length L0 before crimp once stored in the storage section 24, the compression ratio y of the crimp contact terminal 6, and the following expression 5:

$$L1=L0\times y \qquad \text{Expression 5}$$

After calculating the wire barrel length L1 after crimp, the estimation section 26 estimates the cross-sectional shape (crimp state) of the bottom wall 10 and the pair of core wire crimp pieces 11 of the crimp contact terminal 6 positioned between the anvil 14 and the crimper 15 based on the crimp height C/H, the crimp width C/W, the curvature radiuses R and r, and the thickness t stored in the storage section 24 and the wire barrel length L1 after crimp.

Figure 4:
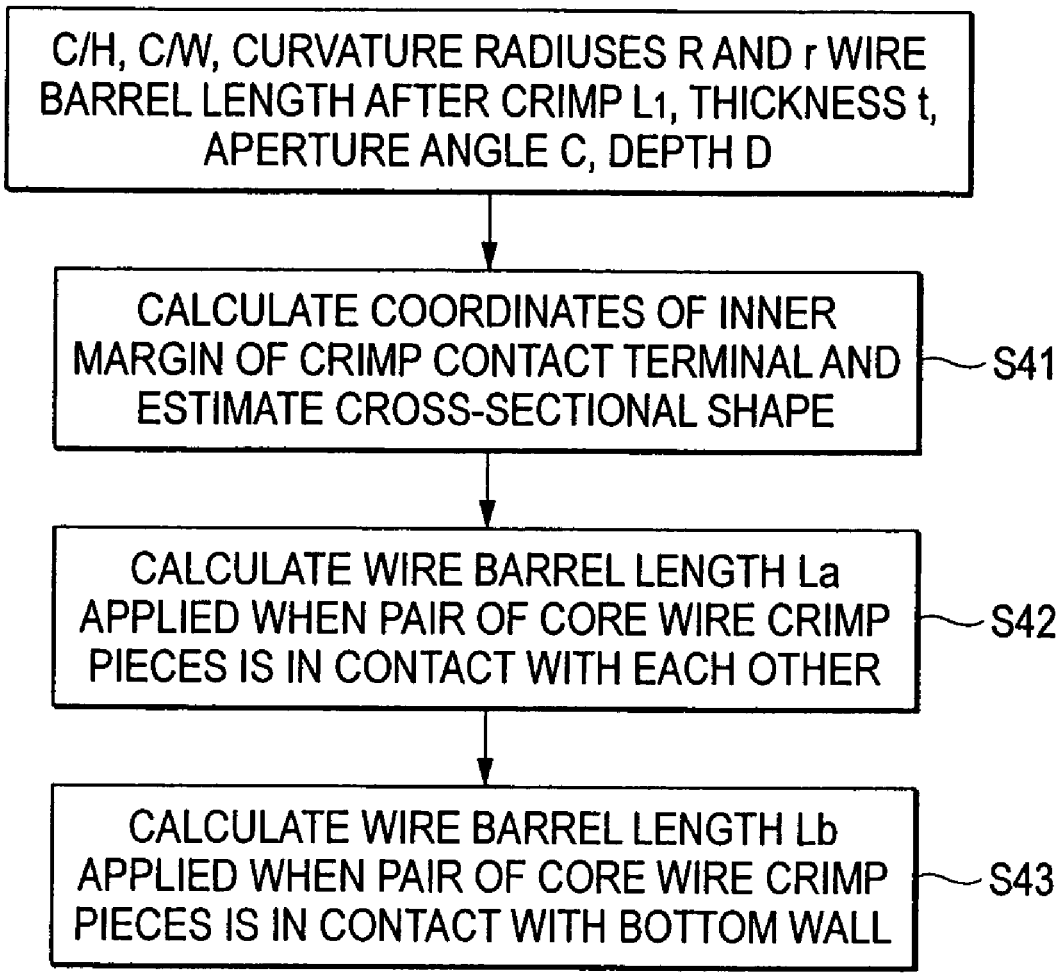
FIG. 4 is a flowchart to show a flow in step S4 in FIG. 2.

To estimate the cross-sectional shape (crimp state), at step S41 in FIG. 4, it is assumed that the thickness after crimp is the thickness t and that the bottom wall 10 and the pair of core wire crimp pieces 11 are formed along the inner faces 16*a* and 17*a* of the recess parts 16 and 17. The estimation section 26 finds coordinates P1, P2, P3, P5, P5, P6, and P7 of inner margins of the bottom wall 10 and the pair of core wire crimp pieces 11 as the wire barrel length L1 (shown in FIG. 8). The estimation section 26 finds the cross-sectional shape of the bottom wall 10 and the pair of core wire crimp pieces 11 passing through the coordinates P1, P2, P3, P5, P5, P6, and P7 orthogonal to the core wire 3. At this time, the wire barrel length L1 is the length halving the thickness t (indicated by the alternate long and short dashed line in FIG. 8).

After finding the cross-sectional shape of the bottom wall 10 and the pair of core wire crimp pieces 11 passing through the coordinates P1, P2, P3, P5, P5, P6, and P7, namely, estimating the crimp state of the crimp contact terminal 6, the estimation section 26 finds the wire barrel length La when the margins 11*a* of the pair of core wire crimp pieces 11 of the crimp contact terminal 6 estimated come in contact with each other. The wire barrel length La at this time is the length halving the thickness t (indicated by the alternate long and short dashed line in FIG. 9).

Further, the estimation section 26 finds the wire barrel length Lb when the margins 11*a* of the pair of core wire crimp pieces 11 of the crimp contact terminal 6 estimated come in contact with the bottom wall 10. The wire barrel length Lb at this time is the length halving the thickness t (indicated by the alternate long and short dashed line in FIG. 10).

The estimation section 26 outputs the estimated crimp state, namely, the cross-sectional shape of the bottom wall 10 and the pair of core wire crimp pieces 11 to both the display section 21 and the output section 22. The estimation section 26 outputs the wire barrel lengths L1, La, and Lb found as described above to the storage section 24. The estimation section 26 further outputs a signal indicating completion of the estimation of the crimp state described above to the crimp height calculation section 27.

Upon reception of the signal indicating completion of the estimation of the crimp state from the estimation section 26 and the calculated compression ratio A1 from the calculation section 25, the crimp height calculation section 27 determines whether or not the difference between the input compression ratio A0 once stored in the storage section 24 and the calculated compression ratio A1 falls below a predetermined value P. If the difference between the input compression ratio A0 and the calculated compression ratio A1 is equal to or greater than the predetermined value P, the crimp height calculation section 27 changes the crimp height C/H a predetermined value ΔP such that the difference between the input compression ratio A0 and the calculated compression ratio A1 is lessened.

The crimp height calculation section 27 causes the calculation section 25 to again calculate the calculated compression ratio A1 and the estimation section 26 to again estimate the crimp state with the crimp height C/H changed ΔP as a new crimp height C/H. When the calculated compression ratio A1 is smaller than the input compression ratio A0, it can be foreseen that the crimp contact terminal 6 will be overcompressed and thus the crimp height calculation section 27 changes the crimp height C/H ΔP so as to increase the crimp height C/H. When the calculated compression ratio A1 is larger than the input compression ratio A0, it can be foreseen that the crimp contact terminal 6 will be undercompressed and thus the crimp height calculation section 27 changes the crimp height C/H ΔP so as to lessen the crimp height C/H.

When the difference between the input compression ratio A0 and the calculated compression ratio A1 falls below the predetermined value P, the crimp height calculation section 27 outputs the crimp height (calculated crimp height) C/H at this time to both the display section 21 and the output section 22. Further, when the difference between the input compression ratio A0 and the calculated compression ratio A1 falls below the predetermined value P, the crimp height calculation section 27 outputs a signal indicating completion of the calculation of the crimp height C/H to the determination section 28.

Thus, the crimp height calculation section 27 finds the crimp height C/H, namely, the spacing between the anvil 14 and the crimper 15 with the difference between the input compression ratio A0 and the calculated compression ratio A1 falling below the predetermined value P. Thus, the estimation section 26 estimates the crimp state when the difference between the input compression ratio A0 and the calculated compression ratio A1 falls below the predetermined value P.

Upon reception of the signal indicating completion of the calculation of the crimp height C/H from the crimp height calculation section 27, the determination section 28 determines whether or not the wire barrel lengths L1, La, and Lb once stored in the storage section 24 satisfy the following expression 6:

$$La \leq L1 < Lb \qquad \text{Expression 6}$$

If the wire barrel lengths L1, La, and Lb satisfy expression 6, the determination section 28 determines that the crimp state of the crimp contact terminal 6 is good. If the wire barrel lengths L1, La, and Lb do not satisfy expression 6, the determination section 28 determines that the crimp state of the crimp contact terminal 6 is bad. The determination section 28 outputs the determination result to both the display section 21 and the output section 22.

Thus, if the wire barrel length L1 after crimp is equal to or greater than the wire barrel length La and is less than the wire barrel length Lb, the determination section 28 determines that the crimp state is good. If the wire barrel length L1 after crimp is less than the wire barrel length La or is equal to or greater than the wire barrel length Lb, the determination section 28 determines that the crimp state is bad.

Thus, in the cross-sectional shape estimated by the estimation section 26 in the spacing between the anvil 14 and the crimper 15 calculated by the crimp height calculation section 27, if the total length L1 of the bottom wall 10 and the pair of core wire crimp pieces 11 after crimp is equal to or greater than the length La applied when the margins 11*a* of the pair of core wire crimp pieces 11 come in contact with each other and is less than the length Lb applied when the margins 11*a* of the pair of core wire crimp pieces 11 come in contact with the bottom wall 10, the determination section 28 determines that the crimp state is good.

If the total length L1 of the bottom wall 10 and the pair of core wire crimp pieces 11 after crimp is less than the length La applied when the margins 11*a* of the pair of core wire crimp pieces 11 come in contact with each other or is equal to or greater than the length Lb applied when the margins 11*a* of the pair of core wire crimp pieces 11 come in contact with the bottom wall 10, the determination section 28 determines that the crimp state is bad.

Next, the process in which the estimation and determination system 1 estimates the crimp state of the crimp contact terminal 6 onto the core wire 3 of the electric wire 2 and determines whether the crimp contact terminal 6 is good or bad will be discussed. To be begin with, at step S1 in FIG. 2, the thickness t of the core wire crimp piece 11 before crimp, the wire barrel length L0 before crimp, the conductor cross-sectional area Sd0 before crimp, the crimp width C/W, the curvature radiuses R and r, the crimp height C/H, the input compression ratio A0, the aperture angle C, and the depth D are input from the information input section 20 to the storage section 24 of the processing unit 23, and the process proceeds to both steps 2 and 3.

At step S2, the calculation section 25 calculates the compression ratio A1 of the core wire 3, namely, finds the calculated compression ratio A1. To find the calculated compression ratio A1 at step S2, at step S21 in FIG. 3, first the calculation section 25 calculates the total cross-sectional area S0 and then proceeds to step S22. At step S22, the calculation section 25 calculates the cross-sectional area St of the crimp contact terminal 6 after crimp using expressions 1 and 2, etc., and proceeds to step S23. At step S23, the calculation section 25 calculates the cross-sectional area of the core wire 3 after crimp, namely, the conductor cross-sectional area Sd using expression 3, etc., and proceeds to step S24. At step S24, the calculation section 25 calculates the compression ratio of the core wire 3, namely, the calculated compression ratio A1 using expression 4. The calculation section 25 thus calculates the calculated compression ratio A1 at step S2 and proceeds to step S6.

At step S3, the estimation section 26 uses expression 5 to calculate the wire barrel length L1 after crimp, namely, the total length of the bottom wall 10 and the pair of core wire crimp pieces 11 after crimp, and proceeds to step S4. At step S4, the estimation section 26 estimates the crimp state, namely, the cross-sectional shape of the crimp contact terminal 6 positioned between the anvil 14 and the crimper 15 brought closest to each other. To estimate the crimp state, first at step S41 in FIG. 4, the estimation section 26 finds the coordinates P1, P2, P3, P5, P5, P6, and P7 of the inner margins of the bottom wall 10 and the pair of core wire crimp pieces 11 and estimates the cross-sectional shape of the bottom wall 10 and the pair of core wire crimp pieces 11 and then proceeds to step S42.

At step S42, the estimation section 26 calculates the wire barrel length La and proceeds to step S43. At step S43, the estimation section 26 calculates the wire barrel length Lb. At step S4, the estimation section 26 thus estimates the crimp state and calculates the wire barrel lengths La and Lb and then proceeds to step S5.

At step S5, the display section 21 displays the estimation result of the estimation section 26, namely, the estimated cross-sectional shape of the bottom wall 10 and the pair of core wire crimp pieces 11 and proceeds to step S6. At step S6, the crimp height calculation section 27 determines whether or not the difference between the input compression ratio A0 and the calculated compression ratio A1 falls below the predetermined value P. If the crimp height calculation section 27 determines that the difference does not fall below the predetermined value P, it proceeds to step S7; if the crimp height calculation section 27 determines that the difference falls below the predetermined value P, it proceeds to step S8.

At step S7, the crimp height calculation section 27 changes the crimp height C/H ΔP so that the difference between the input compression ratio A0 and the calculated compression ratio A1 is lessened, and proceeds to both steps S2 and S3. Thus, the value provided by changing the crimp height C/H ΔP is adopted as a new crimp height C/H and steps S2 and S3 are again executed. Thus, steps S2 and S3 are repeated until the difference between the input compression ratio A0 and the calculated compression ratio A1 falls below the predetermined value P.

At step S8, the determination section 28 determines whether or not the wire barrel length L1 after crimp is equal to or greater than the wire barrel length La applied when the margins 11*a* of the pair of core wire crimp pieces 11 come in contact with each other and is less than the wire barrel length Lb applied when the margins 11*a* of the pair of core wire crimp pieces 11 come in contact with the bottom wall 10. If the determination section 28 determines that the wire barrel length L1 after crimp is equal to or greater than the wire barrel length La applied when the margins 11*a* of the pair of core wire crimp pieces 11 come in contact with each other and is less than the wire barrel length Lb applied when the margins 11*a* of the pair of core wire crimp pieces 11 come in contact with the bottom wall 10, it proceeds to step S9. The determination section 28 determines that the crimp state is good, namely, the crimp contact terminal 6 is good.

If the determination section 28 determines that the wire barrel length L1 after crimp is less than the wire barrel length La applied when the margins 11*a* of the pair of core wire crimp pieces 11 come in contact with each other or is equal to or greater than the wire barrel length Lb applied when the margins 11*a* of the pair of core wire crimp pieces 11 come in contact with the bottom wall 10, it proceeds to step S10. The determination section 28 determines that the crimp state is bad, namely, the crimp contact terminal 6 is bad.

Steps S1 to S7 described above provide a crimp state estimation method. Steps S1 to S10 described above provide a quality determination method of a crimp contact terminal.

According to the embodiment, the estimation section 26 estimates the cross-sectional shape of the bottom wall 10 and the pair of crimp pieces 11 after crimp. Thus, the crimp state of the crimp contact terminal 6 can be grasped. Therefore, the crimp state of the electric wire 2 can be grasped without actually prototyping the crimp contact terminal 6, so that the number of crimp contact terminals to be prototyped at the developing time of the crimp contact terminal 6 can be reduced. Therefore, the time period and the cost taken for developing the crimp contact terminal 6 can be decreased.

The estimation section 26 calculates the total length of the bottom wall 10 and the pair of core crimp pieces 11 after crimp in the orthogonal direction to the core wire 3, namely, the wire barrel length L1 and estimates the cross-sectional shape based on the information on the crimp contact terminal 6, the anvil 16, and the crimper 15, C/H, C/W, R, r, and t, input to the information input section 20.

The estimation section 26 estimates the cross-sectional shape of the bottom wall 10 and the pair of crimp pieces 11 after crimp based on the information on the crimp contact terminal 6, the anvil 16, and the crimper 15, C/H, C/W, R, r, and t, input to the information input section 20 and the wire barrel length L1 after crimp. Thus, the cross-sectional shape of the bottom wall 10 and the pair of core wire crimp pieces 11 after crimp estimated by the estimation section 26 becomes close to the cross-sectional shape of the crimp contact terminal 6 actually crimped on the electric wire 2.

Therefore, the number of crimp contact terminals to be prototyped at the developing time of the crimp contact terminal 6 can be reduced reliably and the time period and the cost taken for developing the crimp contact terminal 6 can be decreased.

The crimp height calculation section 27 finds the crimp height C/H applied when the difference between the input compression ratio A0 and the calculated compression ratio A1 falls below the predetermined value P. Thus, the estimation section 26 estimates the cross-sectional shape of the bottom wall 10 and the pair of core wire crimp pieces 11 after crimp when the difference between the input compression ratio A0 and the calculated compression ratio A1 falls below the predetermined value P.

Thus, the cross-sectional shape of the bottom wall 10 and the pair of core wire crimp pieces 11 after crimp estimated by the estimation section 26 becomes very close to the cross-sectional shape of the crimp contact terminal 6 actually crimped on the electric wire 2. Therefore, the number of crimp contact terminals to be prototyped at the developing time of the crimp contact terminal 6 can be reduced more reliably and the time period and the cost taken for developing the crimp contact terminal 6 can be decreased more reliably.

The calculation section 25 calculates the total cross-sectional area S0 of the core wire 3 of the electric wire 2, the bottom wall 10, and the pair of core wire crimp pieces 11 after crimp. The calculation section 25 calculates the cross-sectional area St of the crimp contact terminal 6 made up of the bottom wall 10 and the pair of core wire crimp pieces 11 after crimp. The calculation section 25 calculates the cross-sectional area of the core wire 3 after crimp, namely, the conductor cross-sectional area Sd from the total cross-sectional area S0 and the cross-sectional area St of the crimp contact terminal 6. The calculation section 25 calculates the calculated compression ratio A1 of the core wire 3 from the cross-sectional area of the core wire 3 after crimp, namely, the conductor cross-sectional area Sd and the conductor cross-sectional area Sd0 before crimp as the information on the electric wire 2 input to the information input section 20. Thus, the calculation section 25 can calculate the calculated compression ratio A1 of the core wire 3 precisely.

Since the calculated compression ratio A1 of the core wire 3 calculated by the calculation section 25 is precise, the crimp height C/H calculated by the crimp height calculation section 27 becomes very precise. Thus, the cross-sectional shape of the bottom wall 10 and the pair of core wire crimp pieces 11 after crimp estimated by the estimation section 26 becomes sill closer to the cross-sectional shape of the crimp contact terminal 6 actually crimped on the electric wire 2. Therefore, the number of crimp contact terminals to be prototyped at the developing time of the crimp contact terminal 6 can be reduced still more reliably and the time period and the cost taken for developing the crimp contact terminal 6 can be decreased still more reliably.

The determination section 28 determines whether the crimp contact terminal 6 is good or bad based on the cross-sectional shape of the bottom wall 10 and the pair of core wire crimp pieces 11 in the direction orthogonal to the core wire 3 after crimp, estimated by the estimation section 26. Thus, whether the crimp contact terminal 6 is good or bad can be determined reliably. Therefore, whether the crimp state of the electric wire 2 is good or bad can be determined without actually prototyping the crimp contact terminal 6, so that the number of crimp contact terminals to be prototyped at the developing time of the crimp contact terminal 6 can be reduced. Therefore, the time period and the cost taken for developing the crimp contact terminal 6 can be decreased.

The determination section 28 determines that the crimp contact terminal 6 is good if the wire barrel length after crimp L1 is equal to or greater than the wire barrel length La applied when the margins 11*a* of the pair of core wire crimp pieces 11 come in contact with each other and is less than the wire barrel length Lb applied when the margins 11*a* of the pair of core wire crimp pieces 11 come in contact with the bottom wall 10. That is, the determination section 28 determines that the crimp contact terminal 6 having the pair of core wire crimp pieces 11 in contact with each other and out of contact with the bottom wall 10 is good.

The determination section 28 determines that the crimp contact terminal 6 is bad if the wire barrel length after crimp L1 is less than the length La applied when the margins 11*a* of the pair of core wire crimp pieces 11 come in contact with each other. That is, the determination section 28 determines that the crimp contact terminal 6 having the pair of core wire crimp pieces 11 out of contact with each other is bad.

Further, the determination section 28 determines that the crimp contact terminal 6 is bad if the wire barrel length after crimp L1 is equal to or greater than the length Lb applied when the margins 11*a* of the pair of core wire crimp pieces 11 come in contact with the bottom wall 10. That is, the determination section 28 determines that the crimp contact terminal 6 having the pair of core wire crimp pieces 11 in contact with the bottom wall 10 is bad.

Therefore, the determination section 28 can reliably determine whether the crimp contact terminal 6 is good or bad. Therefore, the number of crimp contact terminals to be prototyped at the developing time of the crimp contact terminal 6 can be reduced more reliably and the time period and the cost taken for developing the crimp contact terminal 6 can be decreased more reliably.

As described above, according to the present invention, the estimation unit estimates the cross-sectional shape of the bottom wall and the pair of crimp pieces in the direction orthogonal to the core wire after crimp. Thus, the crimp state of the crimp contact terminal can be grasped. Therefore, the crimp state of the electric wire can be grasped without actually prototyping the crimp contact terminal, so that the number of crimp contact terminals to be prototyped at the developing time of the crimp contact terminal can be reduced. Therefore, the time period and the cost taken for developing the crimp contact terminal can be decreased.

The estimation unit calculates the total length of the bottom wall and the pair of crimp pieces after crimp in the orthogonal direction to the core wire and estimates the cross-sectional shape based on the information on the crimp contact terminal, the anvil, and the crimper input to the information input section.

The estimation unit estimates the cross-sectional shape of the bottom wall and the pair of crimp pieces in the direction orthogonal to the core wire after crimp based on the information on the crimp contact terminal, the anvil, and the crimper input to the information input section and the length of the bottom wall and the pair of crimp pieces after crimp in the orthogonal direction to the core wire. Thus, the cross-sectional shape of the bottom wall and the pair of crimp pieces after crimp estimated by the estimation unit becomes close to the cross-sectional shape of the crimp contact terminal actually crimped on the electric wire.

Therefore, the number of crimp contact terminals to be prototyped at the developing time of the crimp contact terminal can be reduced and the time period and the cost taken for developing the crimp contact terminal can be decreased.

According to the invention, the crimp height calculation unit finds the spacing between the anvil and the crimper applied when the difference between the input compression ratio and the calculated compression ratio falls below the predetermined value. Thus, the estimation unit estimates the cross-sectional shape of the bottom wall and the pair of crimp pieces in the direction orthogonal to the core wire after crimp when the difference between the input compression ratio and the calculated compression ratio falls below the predetermined value. Thus, the cross-sectional shape of the bottom wall and the pair of crimp pieces after crimp estimated by the estimation unit becomes very close to the cross-sectional shape of the crimp contact terminal actually crimped on the electric wire. Therefore, the number of crimp contact terminals to be prototyped at the developing time of the crimp contact terminal can be reduced more reliably and the time period and the cost taken for developing the crimp contact terminal can be decreased more reliably.

According to the invention, the calculation unit calculates the total cross-sectional area of the core wire of the electric wire, the bottom wall, and the pair of crimp pieces after crimp. The calculation unit calculates the cross-sectional area of the bottom wall and the pair of crimp pieces after crimp. The calculation unit calculates the cross-sectional area of the core wire from the total cross-sectional area and the cross-sectional area of the crimp contact terminal. The calculation unit calculates the calculated compression ratio of the core wire from the cross-sectional area of the core wire after crimp and the information on the electric wire before crimp input to the information input section. Thus, the calculation unit can calculate the calculated compression ratio of the core wire precisely.

Since the calculated compression ratio of the core wire calculated by the calculation unit is precise, the spacing between the anvil and the crimper calculated by the crimp height calculation unit becomes very close to the actual spacing. Thus, the cross-sectional shape of the bottom wall and the pair of core wire crimp pieces after crimp estimated by the estimation unit becomes sill closer to the cross-sectional shape of the crimp contact terminal actually crimped on the electric wire. Therefore, the number of crimp contact terminals to be prototyped at the developing time of the crimp contact terminal can be reduced still more reliably and the time period and the cost taken for developing the crimp contact terminal can be decreased still more reliably.

According to the invention, the determination unit determines whether the crimp contact terminal is good or bad based on the cross-sectional shape of the bottom wall and the pair of crimp pieces in the direction orthogonal to the core wire after crimp, estimated by the estimation unit. Thus, whether the crimp state of the crimp contact terminal is good or bad can be determined reliably. Therefore, whether the crimp state of the electric wire is good or bad can be determined without actually prototyping the crimp contact terminal, so that the number of crimp contact terminals to be prototyped at the developing time of the crimp contact terminal can be reduced. Therefore, the time period and the cost taken for developing the crimp contact terminal can be decreased.

The estimation unit calculates the total length of the bottom wall and the pair of crimp pieces after crimp in the orthogonal direction to the core wire and estimates the cross-sectional shape based on the information on the crimp contact terminal, the anvil, and the crimper input to the information input section.

The estimation unit estimates the cross-sectional shape of the bottom wall and the pair of crimp pieces in the direction orthogonal to the core wire after crimp based on the information on the crimp contact terminal, the anvil, and the crimper input to the information input section and the length of the bottom wall and the pair of crimp pieces after crimp in the orthogonal direction to the core wire. Thus, the cross-sectional shape of the bottom wall and the pair of crimp pieces after crimp estimated by the estimation unit becomes close to the cross-sectional shape of the crimp contact terminal actually crimped on the electric wire.

Further, the crimp height calculation unit finds the spacing between the anvil and the crimper applied when the difference between the input compression ratio and the calculated compression ratio falls below the predetermined value. Thus, the estimation unit estimates the cross-sectional shape of the bottom wall and the pair of crimp pieces in the direction orthogonal to the core wire after crimp when the difference between the input compression ratio and the calculated compression ratio falls below the predetermined value. Thus, the cross-sectional shape of the bottom wall and the pair of crimp pieces after crimp estimated by the estimation unit becomes very close to the cross-sectional shape of the crimp contact terminal actually crimped on the electric wire.

Thus, the determination unit can determine whether the crimp contact terminal is good or bad based on the cross-sectional shape of the crimp contact terminal of the shape close to that actually crimped on the core wire of the electric wire. Therefore, the number of crimp contact terminals to be prototyped at the developing time of the crimp contact terminal can be reduced still more reliably and the time period and the cost taken for developing the crimp contact terminal can be decreased still more reliably.

According to the invention¥, the determination unit determines that the crimp contact terminal is good if the total length of the bottom wall and the pair of crimp pieces after crimp is equal to or greater than the length applied when the pair of crimp pieces comes in contact with each other and is less than the length applied when the pair of crimp pieces comes in contact with the bottom wall. That is, the determination unit determines that the crimp contact terminal having the pair of crimp pieces in contact with each other and out of contact with the bottom wall is good.

The determination unit determines that the crimp contact terminal is bad if the total length of the bottom wall and the pair of crimp pieces after crimp in the cross section orthogonal to the core wire is less than the length applied when the pair of crimp pieces comes in contact with each other. That is, the determination unit determines that the crimp contact terminal having the pair of crimp pieces out of contact with each other is bad.

Further, the determination unit determines that the crimp contact terminal is bad if the total length of the bottom wall and the pair of crimp pieces after crimp in the cross section orthogonal to the core wire is equal to or greater than the length applied when the pair of crimp pieces comes in contact with the bottom wall. That is, the determination unit determines that the crimp contact terminal having the pair of crimp pieces in contact with the bottom wall is bad.

Therefore, the determination unit can reliably determine whether the crimp contact terminal is good or bad. Therefore, the number of crimp contact terminals to be prototyped at the developing time of the crimp contact terminal can be reduced more reliably and the time period and the cost taken for developing the crimp contact terminal can be decreased more reliably.

According to the invention, the calculation unit calculates the total cross-sectional area of the core wire of the electric wire, the bottom wall, and the pair of crimp pieces after crimp. The calculation unit calculates the cross-sectional area of the bottom wall and the pair of crimp pieces after crimp. The calculation unit calculates the cross-sectional area of the core wire from the total cross-sectional area and the cross-sectional area of the crimp contact terminal. The calculation unit calculates the calculated compression ratio of the core wire from the cross-sectional area of the core wire after crimp and the information on the electric wire before crimp input to the information input section. Thus, the calculation unit can calculate the calculated compression ratio of the core wire precisely.

Since the calculated compression ratio of the core wire calculated by the calculation unit is precise, the spacing between the anvil and the crimper calculated by the crimp height calculation unit becomes very close to the actual spacing. Thus, the cross-sectional shape of the bottom wall and the pair of core wire crimp pieces after crimp estimated by the estimation unit becomes sill closer to the cross-sectional shape of the crimp contact terminal actually crimped on the electric wire. Thus, whether the crimp contact terminal is good or bad can be determined reliably. Therefore, the number of crimp contact terminals to be prototyped at the developing time of the crimp contact terminal can be reduced still more reliably and the time period and the cost taken for developing the crimp contact terminal can be decreased still more reliably.

What is claimed is:

1. A crimp state estimation apparatus for estimating a crimp state of a crimp contact terminal when the crimp contact terminal comprising a bottom wall for positioning a core wire of an electric wire and a pair of crimp pieces upright from opposite margins of the bottom wall and the core wire are held between an anvil and a crimper and are crimped, the crimp state estimation apparatus comprising:

an information input section for inputting information on the crimp contact terminal, the electric wire, the anvil, and the crimper and an input compression ratio of the core wire; and an estimation unit for calculating a total length of the bottom wall and the pair of crimp pieces after crimp in a cross section orthogonal to the core wire based on the information and the input compression ratio and estimating a cross-sectional shape of the bottom wall and the pair of crimp pieces after crimp based on the total length.

2. The crimp state estimation apparatus according to claim 1 further comprising:

a calculation unit for calculating a calculated compression ratio of the core wire based on the information; and a crimp height calculation unit for finding spacing between the anvil and the crimper applied when a difference between the input compression ratio and the calculated compression ratio falls below a predetermined value.

3. The crimp state estimation apparatus according to claim 2, wherein the calculation unit calculates a total cross-sectional area of the core wire, the bottom wall, and the pair of crimp pieces after crimp;

calculates a cross-sectional area of the crimp contact terminal after crimp;

calculates a cross-sectional area of the core wire after crimp based on the total cross-sectional area and the cross-sectional area of the crimp contact terminal; and calculates the calculated compression ratio of the core wire based on the cross-sectional area of the core wire and a cross-sectional area of the core wire before crimp input to the information input section.

* * * * *